United States Patent [19]

Bate et al.

[11] Patent Number: 4,606,501

[45] Date of Patent: Aug. 19, 1986

[54] MINIATURE SPRAY GUNS

[75] Inventors: Anthony J. Bate, Winton; Rowland C. Smith, Wimborne, both of England

[73] Assignee: The DeVilbiss Company Limited, Bournemouth, England

[21] Appl. No.: 648,392

[22] Filed: Sep. 7, 1984

[30] Foreign Application Priority Data

Sep. 9, 1983 [GB] United Kingdom ..... 8324265

[51] Int. Cl.[4] ..... B05B 7/30

[52] U.S. Cl. ..... 239/346; 239/581; 251/345; 251/346

[58] Field of Search ..... 239/346, 413, 416.2, 239/530, 581, 340; 251/340, 343, 345, 346

[56] References Cited

U.S. PATENT DOCUMENTS

| | | | |
|---|---|---|---|
| 2,332,114 | 10/1943 | Robb | 251/344 X |
| 2,550,404 | 4/1951 | Chasen et al. | 239/426 X |
| 3,111,980 | 11/1963 | Spies | 251/346 X |
| 3,987,999 | 10/1976 | Savage | 251/205 |
| 4,020,990 | 5/1977 | Luff | 239/346 |
| 4,037,623 | 7/1977 | Beswick | 251/345 |
| 4,171,097 | 10/1979 | Rebold | 239/346 X |
| 4,265,428 | 5/1981 | Rosemeier et al. | 251/346 |

*Primary Examiner*—Joseph F. Peters, Jr.
*Assistant Examiner*—Daniel R. Edelbrock
*Attorney, Agent, or Firm*—Pollock, Vande Sande and Priddy

[57] ABSTRACT

An external mix miniature spray gun of the airbrush type obtains a spray of paint by directing a jet of gas from a source over a nozzle. A reducing valve for the flow of gas is connected at one end to the source and to an outlet at the other end for discharge into the body of the gun. The reducing valve includes a body of circular end profile with the inlet leading to first generally radial flow passages opening to the side of the valve body and second generally radial flow passages leading from the side of the valve body to the outlet. A sleeve is rotatably retained on the valve body by interengaging threads and spans between the first and second radial passages to define an internal space for gas flow therebetween. A tapered surface in the gas flow space on the interior of the sleeve is arranged to approach or withdraw from a portion of the valve body to enlarge or diminish the gap therebetween as the sleeve is rotated relative to the body. At small degrees of valve opening the second radial passages are masked by the threads of the sleeve so that the threads provide a flow resistance facilitating control at low gas flow rates. With such a valve the flow of air through the airbrush can be shut off in the airbrush itself rather than at the source, the pressure can be adjusted in accordance with the fluid being sprayed, and if the source is an aerosol type bottle the pressure can be regulated to maximize the aerosol life.

6 Claims, 3 Drawing Figures

MINIATURE SPRAY GUNS

FIELD OF THE INVENTION

This invention relates to a spray gun for producing a fine controlled spray of paint or dye in a pattern small enough to enable the gun to be used as an artist's tool. Such spray guns will be referred to as airbrushes.

BACKGROUND OF THE INVENTION

Representative airbrushes of the prior art are shown in Patent Specifications Nos. GB-B-2020578 (Rebold) and U.S. Pat. No. 2,550,404 (Chasan). Representative gas flow control devices are shown in Patent Specifications Nos. GB-A-841895 (Beech) and U.S. Pat. No. 3,987,999 (Savage).

It is an object of the invention to provide an airbrush of the kind in which there is a reducing valve for the compressed gas entering the gun and a separate trigger operated valve for controlling the jet from the gun, in which the principal parts of the reducing valve may be moulded in plastics but in which the reducing valve has a performance approximate to that of a needle valve and is effective at low flow rates.

BRIEF DESCRIPTION OF THE INVENTION

Broadly stated the invention comprises a miniature spray gun including a body carrying a nozzle and means defining a compressed gas path leading through the body to the nozzle, the gas path leading successively through reducing and trigger-controlled valves, the reducing valve being operable by rotation of an external sleeve on the body to vary the length of a flow resistance defined at least over part of the range of travel of the sleeve by interengaging threaded members to preset a resistance to gas flow and the trigger-controlled valve being manually operable to control spraying at the preset flow resistance of the reducing valve.

The invention further comprises an external mix miniature spray gun in which a spray is obtained by directing a jet of gas from a compressed gas source over a capillary paint nozzle, wherein control of the flow of gas from the source is achieved by means of a reducing valve having a gas inlet at one end for connection to the source and a gas outlet at the other end for discharge into a body of the spray gun into which said other end gas tightly fits, said reducing valve including a valve body of circular end profile with said inlet leading from said one end to first generally radial flow passages opening to the side of said valve body and with second generally radial flow passages opening from said side of said valve body nearer said other end and leading to said gas outlet, and a sleeve that is rotatably retained on said valve body by means defining interengaging threads and that spans between said first and second radial passages to define an internal space for gas flow therebetween, in which the second flow passages open through the threaded region of the valve body that is covered by the threaded region of the sleeve when the reducing valve is closed whereby at small degrees of valve opening gas passes along the threads to the second flow passages.

The invention yet further provides an external mix miniature spray gun in which a spray is obtained by directing a jet of gas from a compressed gas source over a capillary paint nozzle, wherein control of the flow of gas from the source is achieved by means of a reducing valve having a gas inlet at one end for connection to the source and a gas outlet at the other end for discharge into a body of the spray gun into which said other end gas tightly fits, said reducing valve including a valve body of circular end profile with said inlet leading from said one end to first generally radial flow passages opening to the side of said valve body and with second generally radial flow passages opening from said side of said valve body nearer said other end and leading to said gas outlet, and a sleeve that is rotatably retained on said valve body by means defining interengaging threads and that spans between said first and second radial passages to define an internal space for gas flow therebetween, a tapered surface in the gas flow space on the interior of the sleeve being arranged to approach or withdraw from a portion of said valve body to enlarge or diminish the gap therebetween as said sleeve is rotated relative to said valve body.

In the above gun the valve sleeve that rotates externally on the handle and the handle itself are intended to be moulded in plastics where fine mating threads are not practical from a moulding standpoint. A performance approximate to that of a conventional needle valve can be provided if the second flow passages open through the threaded region of the reducing valve body that is covered by the threaded region of the sleeve when the reducing valve is closed whereby at least at small degrees of valve opening gas passes along the threads to the second flow passages. Preferably the second flow passages are positioned along the threaded region of the valve body so that they become exposed as the sleeve is moved to a fully open position.

With the above arrangement it has been found that the flow of gas through the airbrush can be shut-off from the airbrush itself rather than at the aerosol cannister or other gas supply normally used, that the pressure can be adjusted to take account of the fluid being sprayed, and that the pressure can be regulated to maximize aerosol life.

The included angle between the spray nozzle and the fluid nozzle is about 90° but versions of the spray gun in which the included angle is about 75° may also be used in some applications.

DESCRIPTION OF THE DRAWINGS

An embodiment of the invention will now be described, by way of example only, with reference to the accompanying drawings, in which.

DESCRIPTION OF THE PREFERRED EMBODIMENTS

Figure 1:
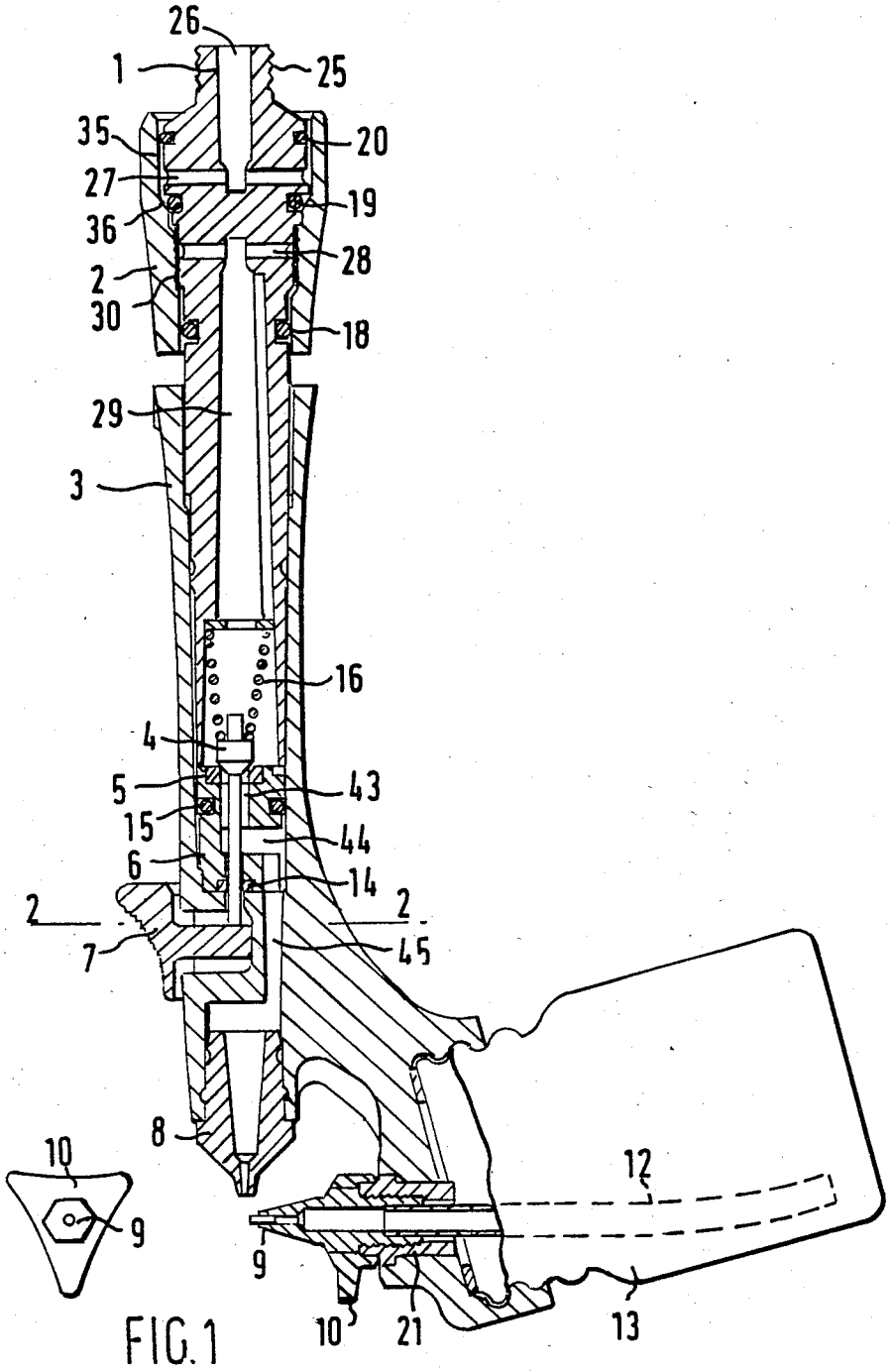
FIG. 1 is a view of an airbrush in longitudinal vertical section.

In the drawings, a reducing valve body 1 of circular end profile is formed at its back end with a hollow threaded nipple 25 to fit onto a threaded end cap of a hose leading from an aerosol bottle, air line or other compressed gas source. A gas inlet passage 26 leads forwardly through the nipple 25 to radial gas flow passages 27 which open to the side surface of the valve body 1. Towards the front end of the valve body 1 second radial gas flow passages 28 lead from the side surface to an axial gas outlet passage 29 that opens towards the front end of the valve body 1. The body 1 is formed on its side surface with a threaded region 30 that engages internal threads on a valve sleeve 2 which is sealed at opposed ends to the valve body 1 by means of front and rear O-rings 18, 20 that locate in grooves in the valve body. Between the sleeve 2 and the body 1 is defined an annular gas flow space that permits gas to flow under pressure between the radial passages 27 and 28.

It will be noted that the rearmost region 35 of the sleeve 2 has a very gentle forwardly convergent taper or draft angle of typically 1°–3° and there is a matching taper on the underlying wall of the valve body 1. Accordingly, as the sleeve 2 is rotated relative to the body 1, the internal surface of region 35 of the sleeve 2 approaches and withdraws from the ends of the radial gas flow passages 27, offering an increased or reduced resistance to gas flow. Further, a third O-ring 19 supported in a groove in the body 1 approaches or withdraws from a more steeply tapering face 36 on sleeve 2 to close or open the reducing valve. The adjustment thread on the sleeve 2 may also pass over the radial flow passages 28 for part of the total adjustment provided.

Figure 3:
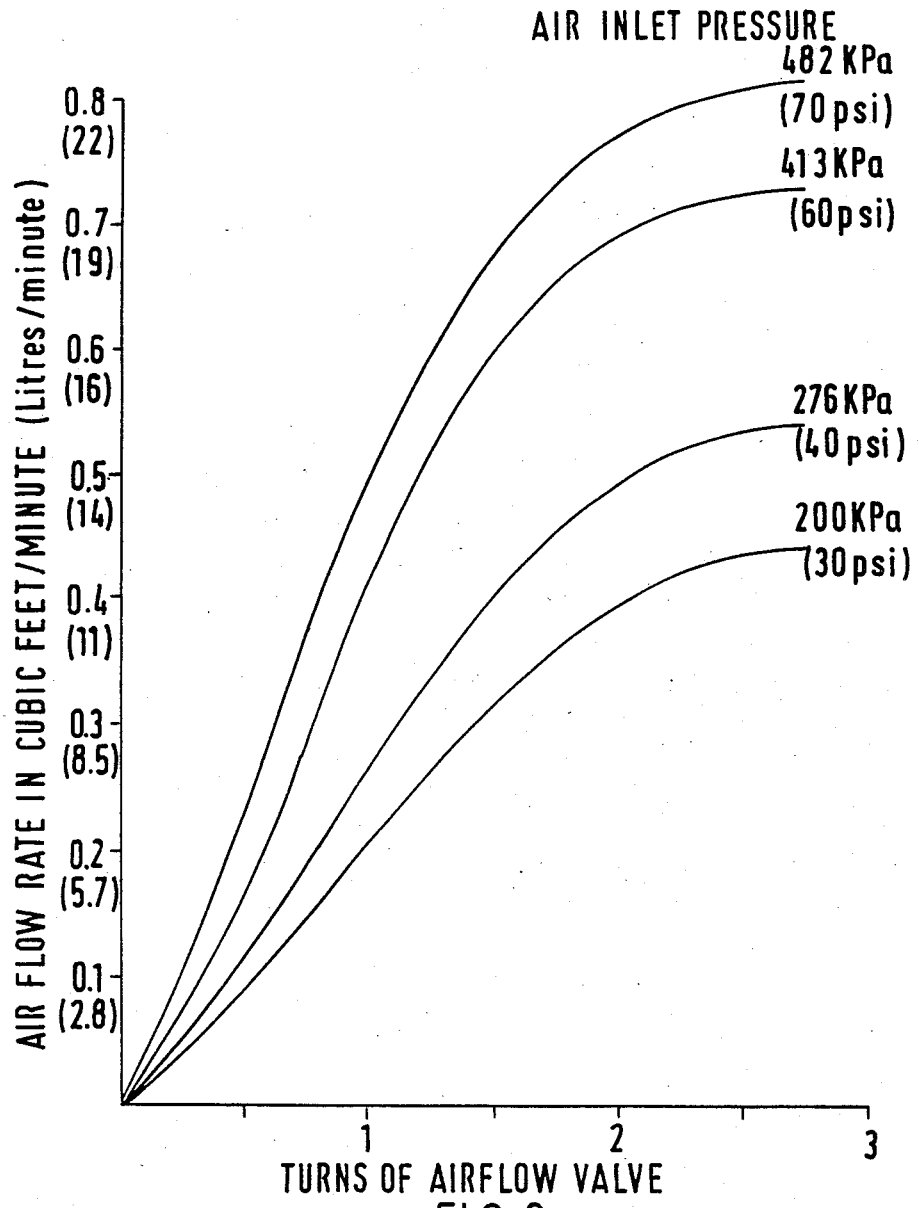
FIG. 3 is a graph showing the relationship between throughput of the reducing valve of the airbrush and number of turns of the valve sleeve for various input pressures.

Thus the tapered rearmost region 35 of the sleeve 2 together with the underlying surface of the valve body act as a needle valve, in which at any given axial position the amount of air that is allowed to pass will be dependent on the diameter of the valve at the control orifice. In the reducing valve for the present spraygun the body 1 and sleeve 2 are to be moulded in plastics and the mating threads 30 have to be of relatively large diameter and pitch to allow them to be moulded. But such coarse threads 30 cannot themselves provide fine control of the airflow at the small flow rates required for special effects spraying using the airbrush. In the reducing valve of FIG. 1 the radial passages 28 open through the threaded region of the body partway along it, and in the illustrated closed position of the valve these passages 28 are covered by the threaded region of the sleeve 2. As the sleeve 2 is rotated to unseat face 36 from O-ring 19 so that the reducing valve starts to open, the air that enters the reducing valve has to pass along the threads 30 before it can enter the passages 28, the length of threads that the air has to pass being adjustable depending upon the number of turns through which the sleeve rotates. As the valve is further opened, the passages 28 are exposed, and a maximum flow rate is achieved. Thus three regions can be expected on the gas flow/sleeve axial position curve. At low degrees of opening there is a region in which the resistance to flow of the threads and resulting back-pressure principally determines the rate of through flow. At an intermediate range of sleeve positions the flow changes as the threads of sleeve 2 disengage from the passages 28. Finally at large valve openings there is another region where the valve acts effectively as a needle valve. The characteristics of such a valve are shown in FIG. 3 which illustrates for various applied pressures the air flow rate through the valve as a function of number of turns from a fully closed position. These show that with careful design a useful control of flow rate over a range of about 3 turns can be obtained whereas with simpler designs regulation may be extremely coarse and may occupy a half-turn only from fully off to maximum flow. The valve body 1 and sleeve are moulded in nylon or polypropylene which are materials that assist in giving complete flow shut-off when required.

Figure 2:
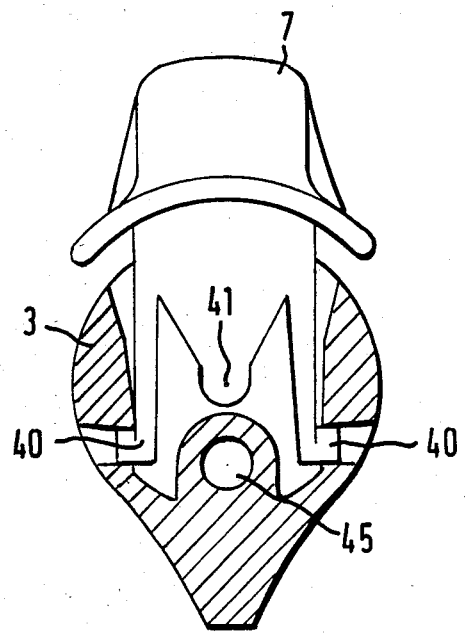
FIG. 2 is a vertical section on the line 2—2 of FIG. 1.

The forward end of the valve body 1 fits gas-tightly into a gun body 3 in which there is an internal chamber whose outlet is controlled by a poppet-like air valve 4 which is slidably guided in a spacer member 6 sealed to the body by O-ring 15. The head of the valve 4 is urged against a seat 5 at the rear end of spacer 6 by means of a partially compressed coil spring 16 and may be lifted therefrom by rearward movement of a trigger 7 pivoted at 40 (FIG. 2) to the valve body 3 and having at about its mid-length an abutment formation 41 that bears on the end of the stem of the air valve 4. An additional O-ring 14 at the front of the spacer member 6 seals the forward end of the valve stem, thereby preventing escape of gas when the valve is actuated. On depression of the trigger 7 gas flows through passages 43, 44, 45 to the air nozzle 8 from which it emerges as a jet.

A fluid cup 13 threadedly engages a holder portion of the gun body that locates the fluid nozzle 9 and depending fluid tube 12 as shown. The fluid nozzle 9 may be adjusted in vertical position by rotation of star wheel 10 attached thereto, the nozzle 9 threadedly engaging a fixed bush 21 so that it rises or falls as it rotates in the fixed bush 21. By raising or lowering the nozzle 9 relative to the air jet 8 which is fixed in position the amount of fluid sprayed can easily be regulated and the width of the spray pattern can be adjusted within a range of line widths of 6—1 with a generally consistant fluid coverage per unit area over this range. Furthermore, by adjustment of the valve sleeve 2 further control may be exercised over fluid atomization to enable speckle or spatter effects to be produced eg to represent concrete or brickwork. This control provided on the brush handle enables the user to set the airbrush more easily to produce the texture desired.

It has been found as a result of experimentation that the included angle between the fluid nozzle 9 and the air or gas nozzle 8 should be about 90°. The horizontal distance between the nozzles 8, 9 may be between a maximum distance of 0.25 cm (0.100 inch) and a minimum distance of 0.15 cm (0.60 inch) and the air nozzle 8 may have a diameter of 0.05–0.075 cm (0.020–0.030 inch). The pattern sprayed is of basically circular form with a fairly well defined spot. The airbrush is capable of operating at pressures from 69–480 KPa (10 to 70 lbf/in$^2$) and has an air consumption of 11 liters/min (0.4 cubic ft/min) of air and resultant fluid (water) flow rate of about 13.5 ml/min of water at 275 KPa (40 psi). A particular set of preferred characteristics for the airbrush is as follows:

Air nozzle orifice=0.76 cm (0.30 inch) diameter
Air flow rate=approximately 12 liters/min (0.43 cubic ft/min) at 275 KPa (40 psi).
Fluid tip orifice=0.0444 cm (0.0175 inch) diameter
Fluid flow=approximately 13.5 ml/min of water at 275 KPa (40 psi)
Angular relationship between air and fluid nozzles=90°
Spray patterns sizes at 414 KPa (60 psi):
- 0.5–2.5 cms (3/16 to 1 inch) diameter at 6 cms (2½ inches) spray distance;
- 6 cms (2½ inches) diameter at 13–15 cms (5 to 6 inches) spray distance.

Air control adjustment=2¾ turns—effective from closed position to full flow.
Fluid tip adjustment=⅜ turn—effective turns from center-line to below center-line.

Various modifications may, of course, be made to the embodiment described above. For example, increased fluid flows are possible by positioning the nozzles 8, 9 in other angular relationships to that shown and when this angle is approximately 75° it has been found that the increased flow thus obtained is not dependant on critical manufacturing tolerances in the distance between the tip of the fluid nozzle 9 and the center line of the air nozzle 8 so that they may each be fixed in a position with no adjustment provided. Thus the invention contemplates that angles between 75° and 90° may be used.

We claim:

1. An external mix miniature spray gun including a body carrying an air nozzle and having means defining a flow path for compressed gas from a compressed gas source through a reducing valve into said body and thence through a separate trigger-operated valve to said air nozzle so that upon actuation of said trigger-operated valve a jet of gas from the compressed gas source is directed over a capillary paint nozzle, said reducing valve having a gas inlet at one end thereof for connection to the source and a gas outlet at the other end thereof for discharge into the body of the spray gun, said other end of said reducing valve being gas tightly fitted into said body of the spray gun, said reducing valve including a valve body of circular end profile with said inlet leading from said one end of said reducing valve to first generally radial flow passages that are defined within said valve body and open into the side of said valve body, second generally radial flow passages defined within said valve body in spaced relation to said first generally radial flow passages and opening from said side of said valve body nearer said other end of said reducing valve, said second generally radial flow passages leading to said gas outlet, and a sleeve that is rotatably retained on said valve body to open and close said reducing valve, said sleeve having threads thereon that are in engagement with threads on the side of said valve body, said valve body threads including threads that are located between said first and second radial passages, the second flow passages opening through the threaded region of the valve body that is covered by the threaded region of the sleeve when the reducing valve is closed, the interengaging threads of said sleeve and valve body defining a flow path upstream of said second passages for the flow of gas along said interengaging threads from said first passages to said second passages at small degrees of valve opening, said flow path exhibiting a flow resistance which is dependent upon the length of the said interengaging threads upstream of said second passages, said flow resistance being varied by rotation of said sleeve relative to said valve body to vary the length of said interengaging threads along which gas flows upstream of said second passages thereby to control the gas flow at small degrees of opening of said reducing valve, and a tapered surface on the interior of said sleeve between said first and second passages upstream of said interengaging threads, such that said tapered surface approaches or withdraws from a portion of said valve body to diminish or enlarge the gap between said surface and said valve body as said sleeve is rotated relative to said valve body to control the gas flow at large degrees of opening of said reducing valve.

2. A spray gun according to claim 1 wherein first and second O-rings of resilient material seal the ends of the sleeve to the valve body.

3. A spray gun according to claim 2, wherein a third O-ring of resilient material located in a groove in said valve body opposes the tapered surface in the sleeve to permit the gas flow to be adjusted or cut off.

4. A spray gun according to claim 1, wherein the sleeve and the valve body are of moulded plastics material.

5. A spray gun according to claim 1, wherein the gas outlet discharges into a chamber within the body, said chamber being closed off by a spring-loaded poppet valve slideably guided in the body and having a stem actuated by a release lever pivoted to the body to lift the head of said poppet valve from a seat and permit gas to flow to said air nozzle.

6. A spray gun according to claim 1, wherein the air nozzle is directed at an angle of about 75° to the capillary paint nozzle.

* * * * *